US010398238B2

(12) United States Patent
Obitts et al.

(10) Patent No.: US 10,398,238 B2
(45) Date of Patent: Sep. 3, 2019

(54) ELECTROMECHANICAL PUSHER ASSEMBLY

(71) Applicant: Fasteners for Retail, Inc., Twinsburg, OH (US)

(72) Inventors: Shane Obitts, Elyria, OH (US); Michael Eric Liedtke, Kent, OH (US); Matthew Grubbs, Union, KY (US)

(73) Assignee: Fasteners for Retail, Inc., Twinsburg, OH (US)

( * ) Notice: Subject to any disclaimer, the term of this patent is extended or adjusted under 35 U.S.C. 154(b) by 180 days.

(21) Appl. No.: 15/460,513

(22) Filed: Mar. 16, 2017

(65) Prior Publication Data

US 2017/0265652 A1 Sep. 21, 2017

Related U.S. Application Data

(60) Provisional application No. 62/309,782, filed on Mar. 17, 2016.

(51) Int. Cl.
*A47F 5/08* (2006.01)
*A47F 1/12* (2006.01)

(52) U.S. Cl.
CPC ..... *A47F 5/0861* (2013.01); *A47F 1/125* (2013.01)

(58) Field of Classification Search
None
See application file for complete search history.

(56) References Cited

U.S. PATENT DOCUMENTS

| | | | | |
|---|---|---|---|---|
| 5,400,919 | A | 3/1995 | Gomm et al. | |
| 7,533,784 | B2 | 5/2009 | Vlastakis et al. | |
| 7,559,437 | B2 | 7/2009 | Colelli et al. | |
| 7,641,072 | B1 | 1/2010 | Vlastakis et al. | |
| 8,190,289 | B2 * | 5/2012 | Lockwood | A47F 1/126 221/15 |
| 8,523,012 | B2 | 9/2013 | Richardson et al. | |
| 8,602,224 | B2 | 12/2013 | Casey | |
| 8,788,091 | B2 | 7/2014 | Bauer | |
| 2002/0107610 | A1 * | 8/2002 | Kaehler | G06Q 20/387 700/232 |
| 2010/0017025 | A1 * | 1/2010 | Lockwood | A47F 1/126 700/240 |
| 2010/0191370 | A1 * | 7/2010 | Barragan Trevino | G06Q 10/06 700/244 |
| 2011/0087369 | A1 * | 4/2011 | Bauer | A47F 1/04 700/232 |
| 2011/0127225 | A1 | 6/2011 | Hooks et al. | |
| 2012/0203376 | A1 * | 8/2012 | Savage | B25H 3/00 700/214 |
| 2012/0253508 | A1 | 10/2012 | Holmes | |

(Continued)

*Primary Examiner* — Gene O Crawford
*Assistant Examiner* — Ayodeji T Ojofeitimi
(74) *Attorney, Agent, or Firm* — Honigman LLP

(57) ABSTRACT

A product dispenser defines a product dispensing path and includes a housing, a pusher, a driver, and a controller. The housing extends along the product dispensing path. The pusher is configured to translate along the product dispensing path. The driver is operably coupled to the pusher and configured to urge the pusher along the product dispensing path. The controller is in communication with the driver and operable to activate the driver to urge the pusher along the product dispensing path after a threshold period of time.

10 Claims, 8 Drawing Sheets

(56) References Cited

U.S. PATENT DOCUMENTS

| | | | | |
|---|---|---|---|---|
| 2015/0096997 | A1* | 4/2015 | Obitts | A47F 1/125<br>221/1 |
| 2016/0012660 | A1* | 1/2016 | Yamamiya | G07F 11/04<br>221/258 |

* cited by examiner

ELECTROMECHANICAL PUSHER ASSEMBLY

CROSS REFERENCE TO RELATED APPLICATIONS

This U.S. patent application claims priority under 35 U.S.C. § 119(e) to U.S. Provisional Application 62/309,782, filed on Mar. 17, 2016. The entire disclosure of this prior application is considered part of the disclosure of this application and is hereby incorporated by reference in its entirety.

FIELD

The present disclosure generally relates to shelving systems used in the merchandising of articles for sale. More particularly, it is pertinent to a shelving system which deters the theft of products from a retail merchant.

BACKGROUND

This section provides background information related to the present disclosure and is not necessarily prior art.

Shelving is used extensively for stocking and storing products or merchandise in a variety of stores. Many stores simply employ shelves on which merchandise is stocked. In such stores, if the shelves are not at eye level, it is difficult for the customer to see items being displayed if the items are not located adjacent the front edge of the shelf. Merchants have therefore employed forward feed devices to automatically move an item forward on a shelf, as the item before it is removed. Forward feed devices are usually associated with divider walls that are located on either side of a pusher assembly mounted on a track, i.e., a pusher system, so as to maintain the merchandise in neatly organized columns.

One difficulty that merchants often face, especially when items are pushed to the front of the shelf so as to enhance their visibility, is the problem of theft. The theft of items in retail stores is all too common a problem. Items which are in high demand by thieves include over-the-counter medicines, perfumes, teeth whitening products, razor blades, batteries, DVDs, smoking cessation products and the like. Shelf sweeping is a type of theft which occurs when individuals or groups remove most or all the stock on a shelf and exit the store without paying, similar to a "smash and grab" shoplifting technique. This is a particular problem for small items. Shelf sweeping relies on large quantities of product being readily available on the shelf. While merchants prefer to keep substantial inventory on the shelf in order not to incur labor costs in constantly restocking shelves, the presence of such inventory on the shelf makes it easier for thieves to sweep the shelf.

Retailers are constantly challenged to balance the needs of a legitimate consumer's access to high theft items with attempts to minimize the incidence of theft.

Because theft is so prevalent in certain product categories, many retail stores are taking certain products, such as razors, some over-the-counter medicines and infant formula, off the shelf and placing them behind the counter or under lock and key. If this is done, a customer must request such products from a sales associate. This requires additional labor costs to provide individual service to a customer who otherwise would not need such service. It also makes it difficult for customers to compare products. In addition, the storage of high theft items behind the counter may be problematic as counter space is limited and may be needed for prescription medications and the like. Therefore, a forward feed apparatus which minimizes the incidence of product theft would be desirable.

In addition to preventing theft, retail stores may wish to limit the purchase of certain over-the-counter medicines, such as cold medications, that may have active ingredients that could be misused and may well be addictive.

Studies have shown that a desirable form of theft deterrence is to cause a time delay between the dispensing of multiple products held on a shelf. Would-be thieves are less likely to steal products if there is a substantial delay between the dispensing or vending of a first package and of a subsequent package. While certain time delay vending systems are known, there remains a need for a better designed and simpler product dispenser having a time delay feed device.

SUMMARY

This section provides a general summary of the disclosure, and is not a comprehensive disclosure of its full scope or all of its features.

One aspect of the disclosure provides a system for dispensing products. The system may include a dispensing device that controls access to products stored within the device. The device may include a housing, a pusher, and a feed device. The housing may include a shroud. The pusher may be movable along an axis of the housing. The feed device may be configured to move the pusher along the longitudinal axis of the housing. The system further includes a sensor that senses when an item is removed from the housing and controls the movement of the feed device with a time delay.

Implementations of the disclosure may include one or more of the following optional features. In some implementations.

Another aspect of the disclosure provides . . . . This aspect may include one or more of the following optional features.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

Figure 1:
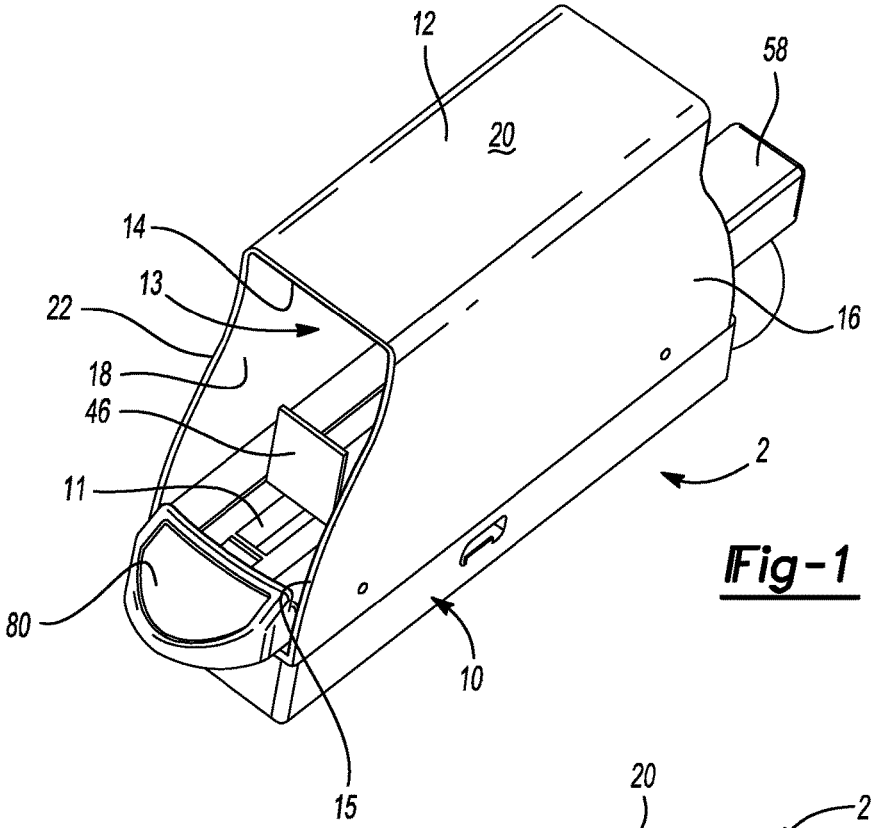
FIG. 1 is a perspective view of a product dispenser in accordance with the principles of the present disclosure.

With reference now to FIG. 1, disclosed herein is a product dispenser 2 which is suited for shelf level loss prevention, particularly for high value items such as various cosmetics, over-the-counter medicines, smoking cessation products, teeth whitening strips and the like. The product dispenser 2 may include a housing 10 and a shroud 12 and may define a product dispensing path 11. The housing 10 may be constructed of metal or plastic and the shroud 12 may be constructed of a transparent material such as plastic. The housing 10 and the shroud 12 may extend along the product dispensing path 11.

Figure 2:
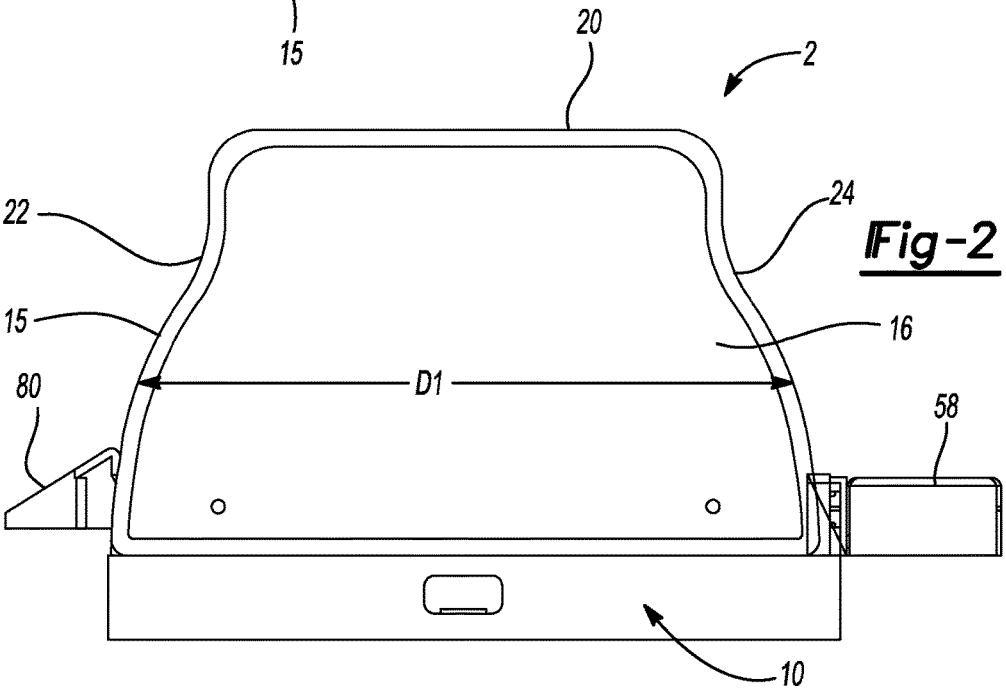
FIG. 2 is a side elevational view of the product dispenser of FIG. 1.

The shroud 12 may be mounted to the housing 10 in any known manner to retard access to products held by the housing 10, and to collectively define a channel 13 extending along the product dispensing path 11. In this regard, the shroud 12 may only allow access to products disposed in the channel 13 through an opening 14 defined in and/or by a front end 15 of the shroud 12. The shroud 12 may include a first side wall 16, a second side wall 18 and a top wall 20. As is evident from FIG. 2, the shroud 12 may include a tapered front surface or edge 22 and/or a tapered rear surface or edge 24. In this regard, a distance D1 between the front edge 22 and the rear edge 24 may increase in a direction extending toward the top wall 20. In some implementations, the tapered front and/or rear edge 22, 24 is defined by the first and/or second side wall 16, 18. The tapered front surface or edge 22 may allow manual access to a first product or package held in the housing 10 (see FIG. 4).

Figure 3:
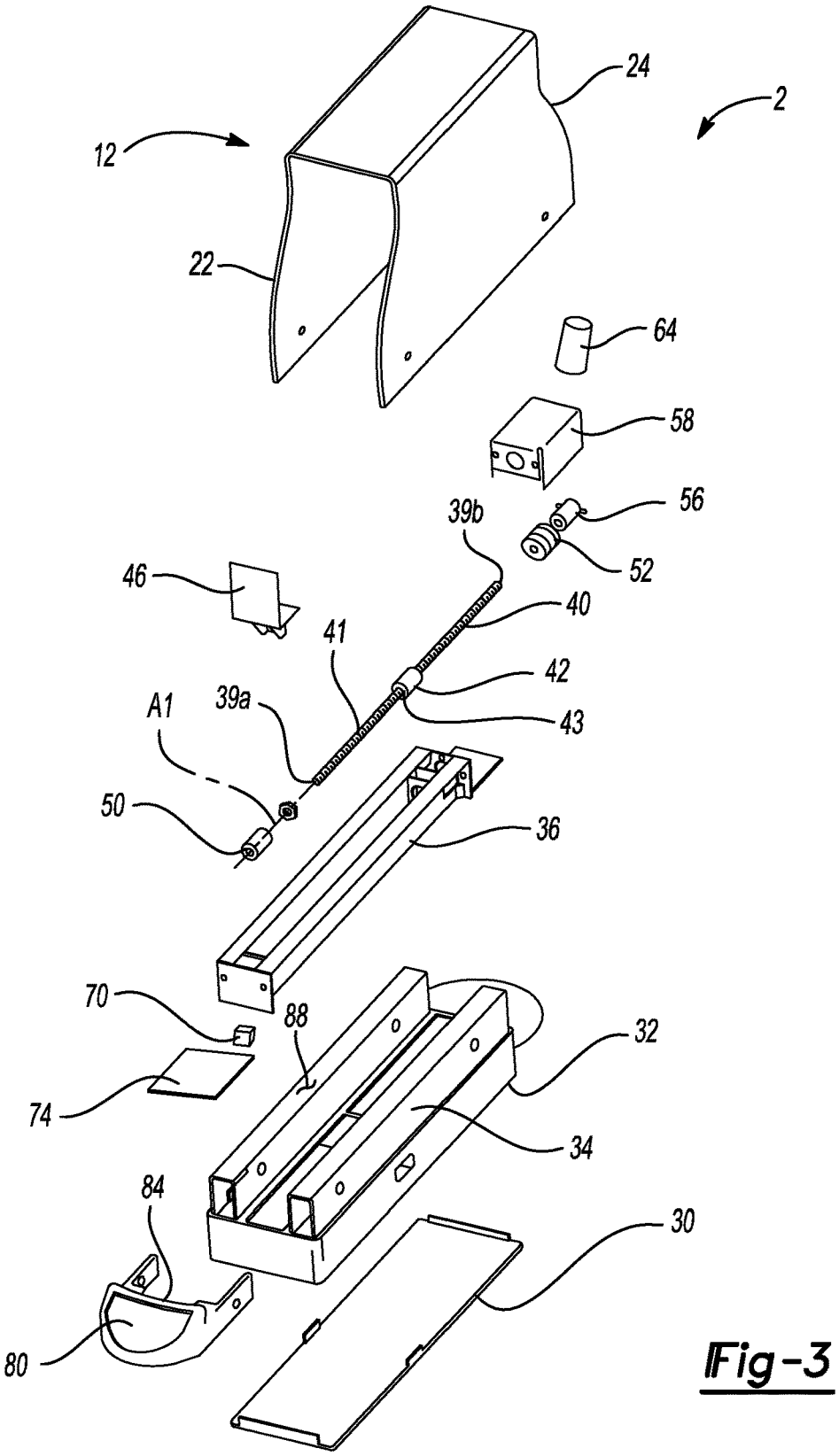
FIG. 3 is an exploded perspective view of the product dispenser of FIG. 1.

With reference now also to FIG. 3, the housing 10 of the product dispenser 2 may include a bottom cap 30, an external frame 32, a drive system frame 36, a feed device 40, a platform or paddle interface 42, a motor 56, a power source 64, at least one proximity sensor or micro switch 70, and a controller 74. In some implementations, the bottom cap 30 is mounted to the external frame 32. The frame 32 may include side walls 34. The drive system frame 36 may be mounted to the external frame 32.

The feed device 40 may be disposed in, or otherwise mounted to, the drive system frame 36. In some implementations, the feed device 40 includes a worm gear extending from a front end 39*a* to a rear end 39*b* along a longitudinal axis A1. In this regard, the feed device 40 may be referred to herein as the "worm gear 40." The worm gear 40 may include an acme thread 41, or any other thread known in the art. The platform or paddle interface 42, which may be referred to herein as a "base 42," may be mounted on the feed device 40. For example, the base 42 may include a threaded bore 43 in which the worm gear 40 is disposed and/or threadably coupled, such that rotation of the feed device 40 about the longitudinal axis A1 urges translation of the platform 42 and the pusher paddle 46 mounted thereto linearly along the axis A1 of the feed device 40 in at least a forward direction. Put another way, the rotational motion of the feed device 40 is converted into a linear motion of the pusher paddle 46, thereby advancing product forwardly in the product dispenser 2.

The front end 39*a* of the feed device 40 may be mounted to a bushing 50, and the rear end 39*b* of the feed device 40 may be mounted a coupling 52. The bushing 50 and coupling 52 may each be supported by, or otherwise mounted to, the frame support 36. The coupling 52 may be connected to the motor 56, such that rotation of the motor 56 causes the rotation of the feed device 40 about the longitudinal axis A1. In some implementations, the motor 56 is disposed in a motor shroud 58. The power source 64 may be coupled to the motor 56 in order to provide power thereto, and may include a battery pack, or any of a variety of other known power sources. The provision of a portable power source (e.g., a battery back) may allow for operation of the product dispenser 2 without coupling the product dispenser to a building's power supply.

The at least one proximity sensor or micro switch 70 and the controller 74 may be disposed in the housing 10. The sensor 70 may be in communication (e.g., wired or wireless) with the controller 74. In some implementations, the micro switch 70 is disposed at a front end 72 (FIG. 1) of the housing 10. The controller 74 may include a printed circuit board or a logic system 74 for selectively actuating the motor 56 based on the signal sent by the sensor 70. The controller 74 can be a processing device along the lines of a micro controller or other suitable processor which is well-known in the art. Electrical power to the controller 74 can be provided by the power source 64 which also powers the motor 56.

In some implementations, the controller 74 encrypts and packages or processes the data from the one or more sensors 70 and sends the data, such as by RF communications, to a central data analysis unit 78 for the store so that the merchant has instant updates on which product is being offered for sale, at which product dispenser (e.g., product dispenser 2), located on which shelf, in which aisle of the store. In this way, the store owner can track occurrences, such as when a product has been removed from a product dispenser, the number of products which were removed from a given shelf, the number of products which remain on the shelf, consumer buying patterns, and possible theft.

Also illustrated in FIG. 3 is a product dispenser actuator, or front facing 80, located at a front end of the product dispenser 2 and secured to the external frame 32. In some implementations, the front facing 80 constitutes a front end of the product dispenser 2. In this regard, the front facing 80 may be disposed proximate the front end 15 of the shroud 12. Due to the tapered front surface or edge 22 of the shroud 12, access can be had through the opening 14 only to a first product in a column of products held in the dispenser 2. For example, due to the tapered front surface or edge 22 of the shroud 12, only the product disposed at or closest to the front end 15 of the shroud 12 may be accessible through the opening 14. Accordingly, as illustrated in FIG. 4 the shroud 12 retards the ability of a shopper to access any package 86, other than the front package 86, held in the dispenser 2.

In some implementations, the front facing 80 includes a blocking wall 84 which is configured to prevent the column of packages 86 held in a product dispenser from moving out of the housing 10 when urged by the pusher 46. In this regard, the blocking wall 84 may extend in a direction transverse to the longitudinal axis A1 and above an upper surface 88 of the sidewalls 34 of the external frame 32. As mentioned, only a single product or package 86 (FIG. 4) is available to the shopper because the shroud 12 extends over the remainder of the column of packages.

Figure 4:
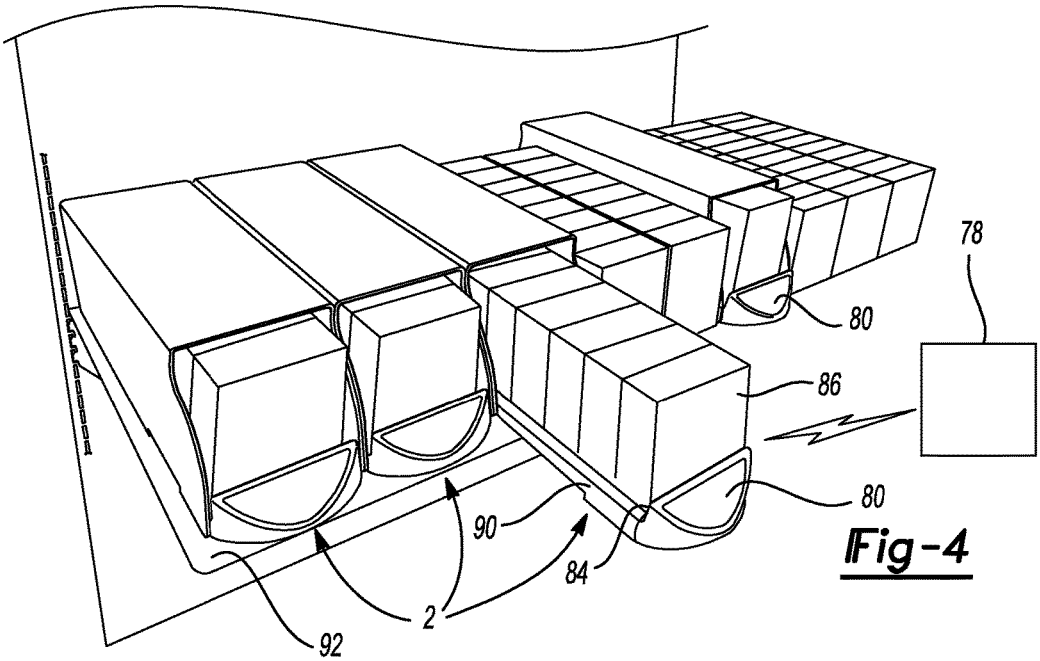
FIG. 4 is a perspective view of a merchandising assembly including a plurality of the product dispensers of FIG. 1 mounted on a shelf as would be present in a retail environment.

In some implementations, one or more of the product dispensers 2 includes a sliding frame 90, as illustrated in FIG. 4. As is evident, a plurality of product dispensers 2 can be mounted on a shelf 92 in a side-by-side manner. Several product dispensers 2, which can accommodate packages 86 having a variety of sizes and shapes, can be mounted on a single shelf 92 with each column of packages 86 being disposed in its own respective product dispenser 2.

Figure 5:
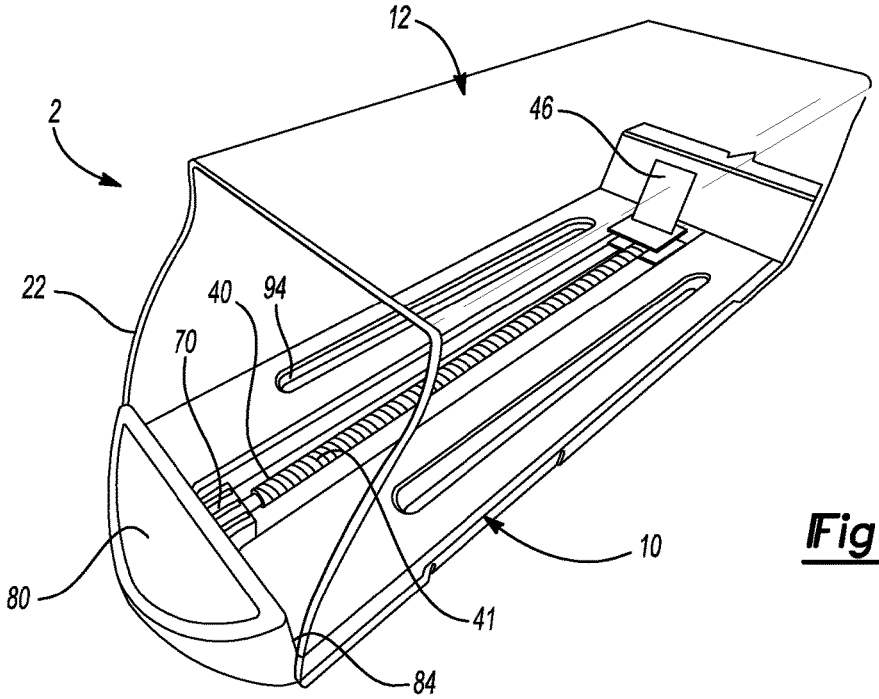
FIG. 5 is a perspective view of one of the product dispensers of FIG. 4 on an enlarged scale.

With reference now to FIG. 5, one or more cutouts 94 may be located in the housing 10 on one or both sides of the feed device 40. In some implementations, the cutouts 94 define a channel or groove extending in a direction substantially parallel to the longitudinal axis A1. The cutouts 94 reduce the amount of material, and thus material costs, for the housing 10. For example, as illustrated in FIG. 5, two such cutouts 94 may be disposed in the housing 10 in a laterally-spaced apart arrangement, such that the feed device 40 is centrally positioned between the cutouts 94.

Figure 6:
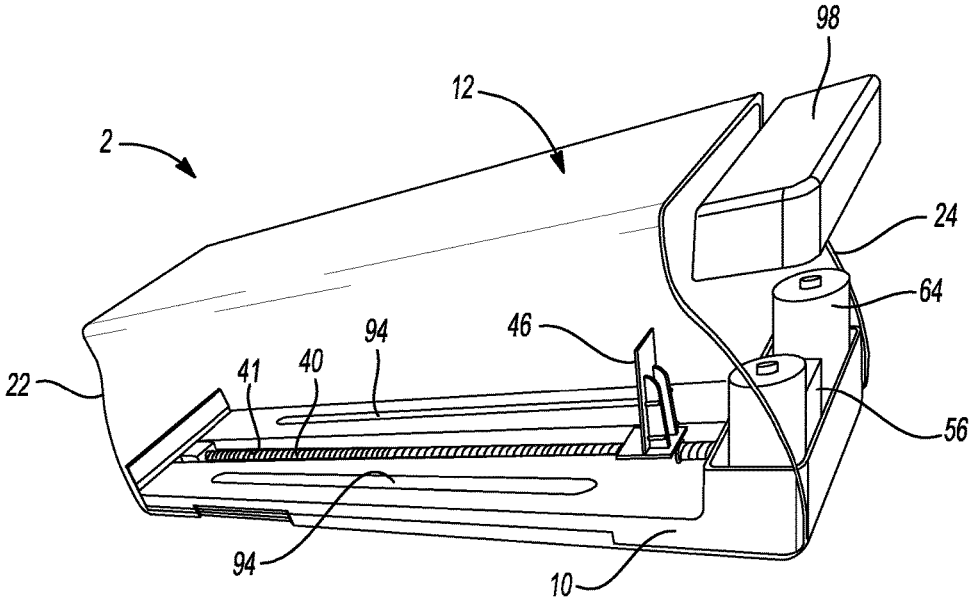
FIG. 6 is a rear perspective view of the product dispenser of FIG. 5, with a portion exploded away.

With reference now to FIG. 6, in some implementations, each product dispenser 2 holds its own power supply 64 (e.g., battery pack). To this end, each product dispenser 2 may include a shroud 98 in which both a battery pack 64 and a motor 56, mounted to the housing 10, are disposed. In this regard, the shroud 98 may cover the battery pack 64 and the motor 56 of a particular product dispenser 2.

Figure 7:
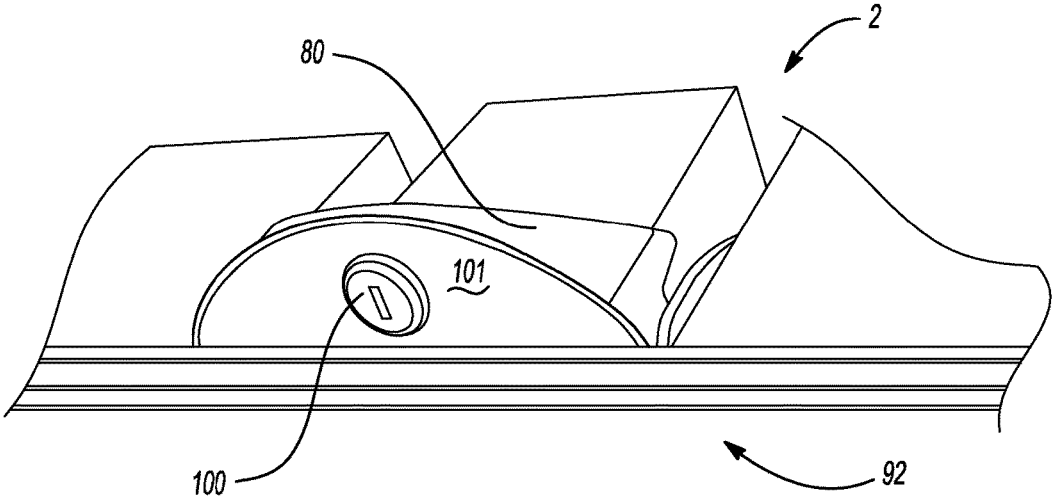
FIG. 7 is a bottom perspective view of a portion of the shelving assembly illustrated in FIG. 4 on an enlarged scale.

With reference now to FIG. 7, in some implementations, each product dispenser 2 includes a lock 100. The lock 100 may be disposed on a bottom face 101 of the product dispenser actuator 80 in order to prevent a pull out track or sliding frame 90 from being accessed by a thief in an attempt to defeat the presence of the shroud 12. The lock 100 may be accessible only from underneath the shelf 92. In some implementations, the lock 100 is actuatable between a locked and an unlocked orientation with a key. It should be apparent that store personnel may be provided with keys so that they can unlock the sliding frame 90 and pull out the track (e.g., one or both of the external frame 36 and the drive system frame support 32) for restocking of packages 86, as is evident from, e.g., FIG. 4.

In some implementations, the indexing of the pusher paddle 46 forward by the feed device 40 is delayed by the controller 74 by, for example, a time period lasting anywhere from 15 seconds to 60 seconds upon the sensing, by the sensor 70, of a package 86 being removed from the product dispenser 2. To this end, the sensor 70 may be covered by the package(s) 86 under normal circumstances. When the forward-most package 86 is removed by a shopper, the sensor 70 may transmit a signal to the controller 74 notifying the controller 74 of the removal of the package 86. The controller 74 may, in turn trigger, or otherwise instruct, the motor 56 to advance the feed device 40 by a given amount after a determined amount of time (e.g., 15 seconds to 60 seconds), so as to retard the ability of a potential thief to take more than one package 86 at a time from the product dispenser 2. In this regard, the controller 74 may instruct the motor 56 to rotate after the predetermined amount of time, thus rotating the feed device 40 about the longitudinal axis A1, and causing the pusher paddle 46 to translate along the longitudinal axis A1 after the predetermined amount of time.

If the proximity sensor 70 has been triggered, the controller 74 may start a sensor timer 104 (FIG. 3). The motor 56 will thereafter be activated after the predetermined amount of time (e.g., 15, 30 or 60 seconds or any other desired amount of time delay). Thereafter, the motor rotates the feed device 40 and urges the pusher paddle 46 forward in the housing 10 along the axis A1. Thus, further packages 86 held in the column of packages 86 in the housing 10 are advanced towards the front end 15 of the shroud 12 and a front end of the shelf 92, thereby allowing access to the further packages 86. As mentioned, the wall 84 of the front facing 80 serves to limit a forward movement of the column of packages 86. In particular, the packages 86 may abut the wall 84 of the front facing 80 upon moving forward relative to the housing 10.

In order to restock the product dispenser 2, it is contemplated that the rotational direction of the feed device 40 can be reversed so that the pusher paddle 46 is retracted by the motor 56 in the housing 10. For example, rotation of the feed device 40 in an opposite direction about the longitudinal axis A1 may cause the pusher paddle 46 to move away from the front end 15 of the shroud 12 along the axis A1. In some implementations, the pusher paddle 46 can be disengaged from the feed device 40 so that the paddle 46 can be quickly retracted in the housing 10. For example, disengaging the feed device 40 from the paddle 46 may allow a user to translate the paddle 46 along the axis A1 without rotating the feed device 40. In this way, a plurality of packages 86 can be quickly loaded into the product dispenser 2.

Figure 8:
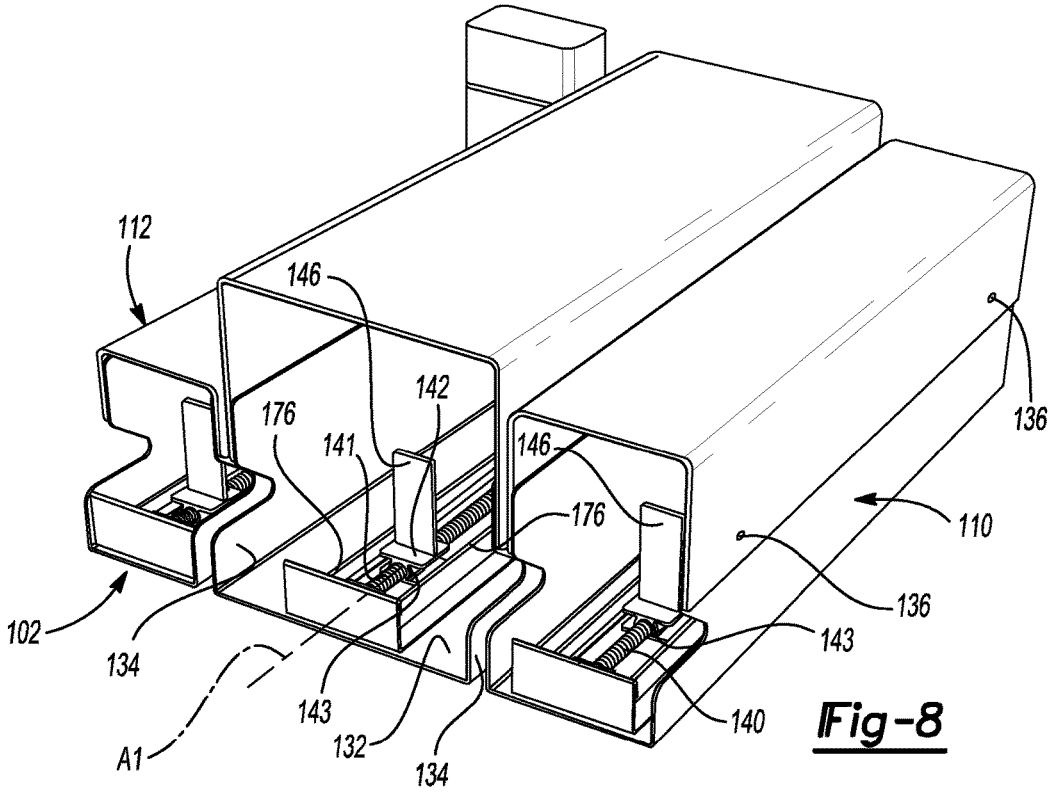
FIG. 8 is a front perspective view of a merchandising assembly including several product dispensers in accordance with the principles of the present disclosure.

With reference now to FIG. 8, another product dispenser 102 according to the present disclosure is illustrated. The product dispenser 102 may include a housing 110 and a shroud 112. The shroud 112 may be mounted to the housing 110. The housing 110 may include a base wall 132 and a pair of spaced side walls 134 located on either side of the base wall 132. A plurality of fasteners 136 may be employed to connect or fasten the shroud 112 to the housing 110.

Figure 9:
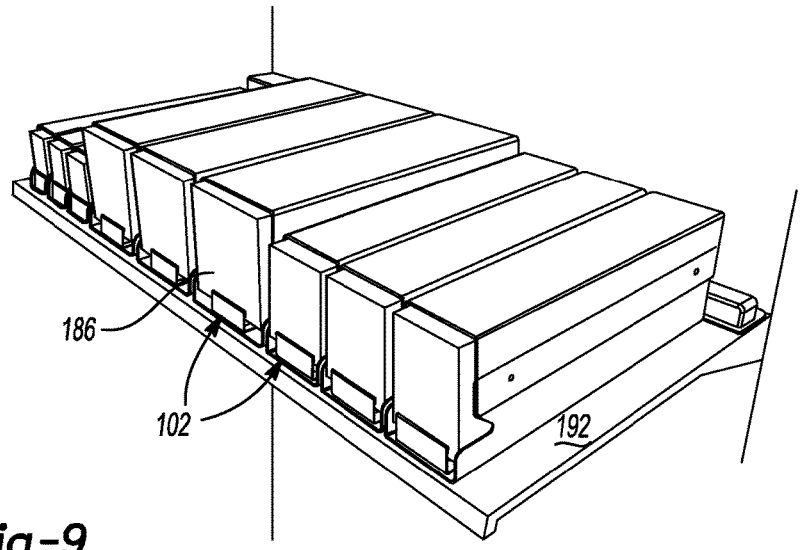
FIG. 9 is a reduced perspective view of the product dispensers of FIG. 8 mounted on shelf and displaying a plurality of product sizes which are available for sale.

Mounted in the housing 110 is a feed device 140. In some implementations, the feed device 140 includes a worm gear. In this regard, the feed device 140 may be referred to herein as the "worm gear 140." The worm gear 140 may include an acme thread 141, or any other thread known in the art. Mounted to the feed device 140 is a platform 142 which engages the worm gear 140 and supports a paddle 146. For example, the platform 142 may include a threaded bore 143 in which the worm gear 140 is disposed and/or threadably coupled, such that rotation of the worm gear 140 about the longitudinal axis A1 urges translation of the platform 142 and the pusher paddle 146 mounted thereto linearly along the axis A1 of the feed device 140 in at least a forward direction. A motor 156 (see FIG. 11) can be employed to selectively actuate the feed device 140. The actuation of the motor 156 may be determined by one or more sensors 170 (see FIG. 10) disposed in a housing 172. In some implementations, the product dispenser 102 includes three sensors 170 to accurately assess the presence or absence of a package 186 (FIG. 9) located on the sensor 170. Thus, if there are three sensors 170, the controller (e.g., controller 74) can survey (e.g., receive signals from) the three sensors 170 and actuate the motor 156 if at least two of the sensors 170 indicate that a package 186 has been removed. In some implementations, the three sensors 170 actuate the motor 156 only if a majority (e.g., at least two out of three) of the sensors 170 indicate that a package 186 has been removed.

A front end 139*a* of the feed device 140 may be mounted to the housing 172. As evident from FIG. 9, one or more packages 186 may be held in a product dispenser 102, and a plurality of such product dispensers 102 may be arranged in a side-by-side manner on a shelf 192. It should be apparent that a variety of different sizes of product dispensers can be mounted on the shelf 192 to accommodate different sizes and shapes of packages 186 held by the dispensers 102.

As illustrated in FIG. 8, it is contemplated that different sizes of shrouds 112 and product dispenser housings 110 may be provided for different sizes and types of packages 186. In some implementations, the size or shape of the shrouds 112 may be adjustable. For example, the width or height of the shroud 112 may be adjustable, so that the number of different sizes of shrouds 112 necessary to accommodate the varying sizes of packages 186 being sold by the merchant can be reduced. Thus, in some implementations, several product dispensers 102 of different widths may be provided and shrouds 112 that can be adjusted in height and width can be mounted to the corresponding housings 110 in order to accommodate the vast variety of product package sizes and shapes being sold with relatively few product dispenser types.

Figure 10:
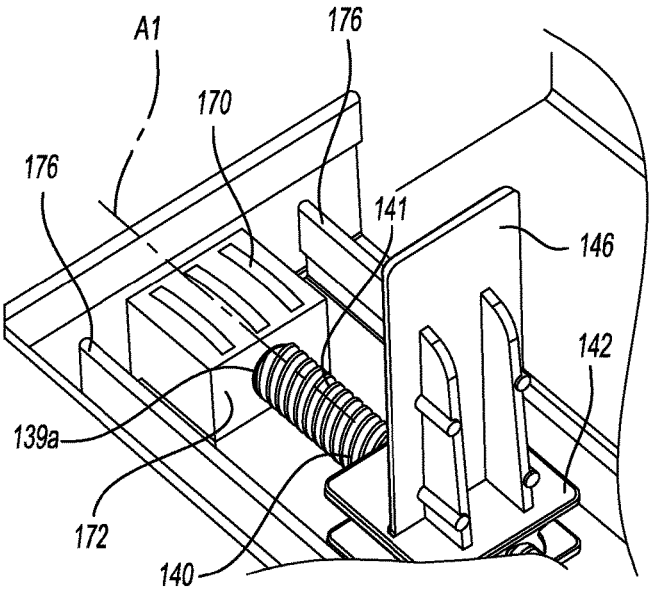
FIG. 10 is a greatly enlarged perspective view of a forward portion of one of the product dispensers of FIG. 8.

As is evident from FIG. 10, the product dispenser 102 may further include a pair of spaced support walls 176. A first of the spaced support walls 176 may be disposed on a first side (e.g., lateral) of the sensor housing 172, and a second of the spaced support walls 176 may be disposed on a second side (e.g., medial) of the sensor housing 172. The second side of the sensor housing 172 may be opposite the first side of the sensor housing 172. The support walls 176 may extend parallel to one another and to the longitudinal axis A1, and may support the packages 186 for translation within the housing 110 or shroud 112 along the axis A1. In this regard, the support walls 176 serve as spacing elements to reduce friction as packages 186 are pushed forward in the product dispenser by the paddle 146.

Figure 11:
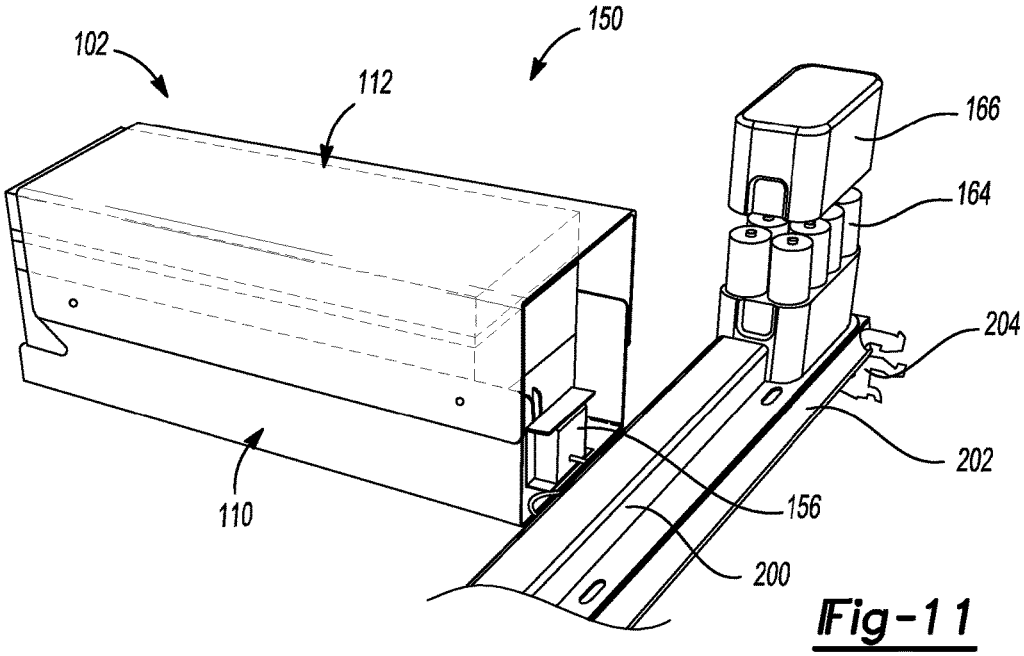
FIG. 11 is a rear perspective view of a product dispenser of FIG. 9 in a partially exploded state.
Figure 12:
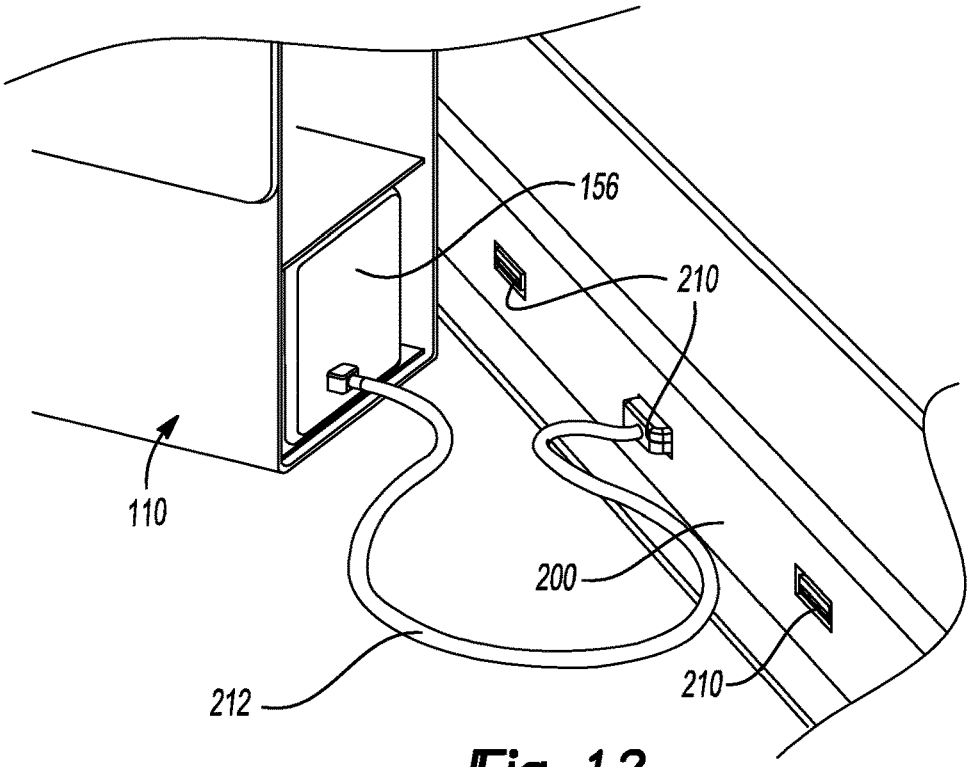
FIG. 12 is a greatly enlarged perspective view of a portion of the assembly illustrated in FIG. 11.

With reference now to FIG. 11, a merchandising system 150 including the product dispenser 102 may further include a power rail 200 for powering a plurality of motors 156 mounted in respective housings 110. The power rail 200 may be supported by a base 202. The base 202 may be mounted to a vertically extending support structure (not shown) via conventional brackets 204. The power rail 200 may be connected to a battery pack 164 enclosed by a battery shroud 166. As illustrated in FIG. 12, the power rail 200 may include a series of horizontally spaced outlets 210. Each outlet 210 may be capable of accommodating a power cord 212 in order to electrically connect the respective electrical motor 156 to the power rail 200.

It is also contemplated that the several controllers (e.g., controller 74) activating their respective motors can be connected to each other or to a central controller. In this way, if one product (e.g., packages 86, 186) is removed from one product dispenser 102 on a shelf 192, the other product dispensers 102 on the shelf 192 can be locked out for some period of time, thereby deterring a potential thief from taking the first product or package 186 from each of the several product dispensers 102 located on that shelf 192.

Figure 13:
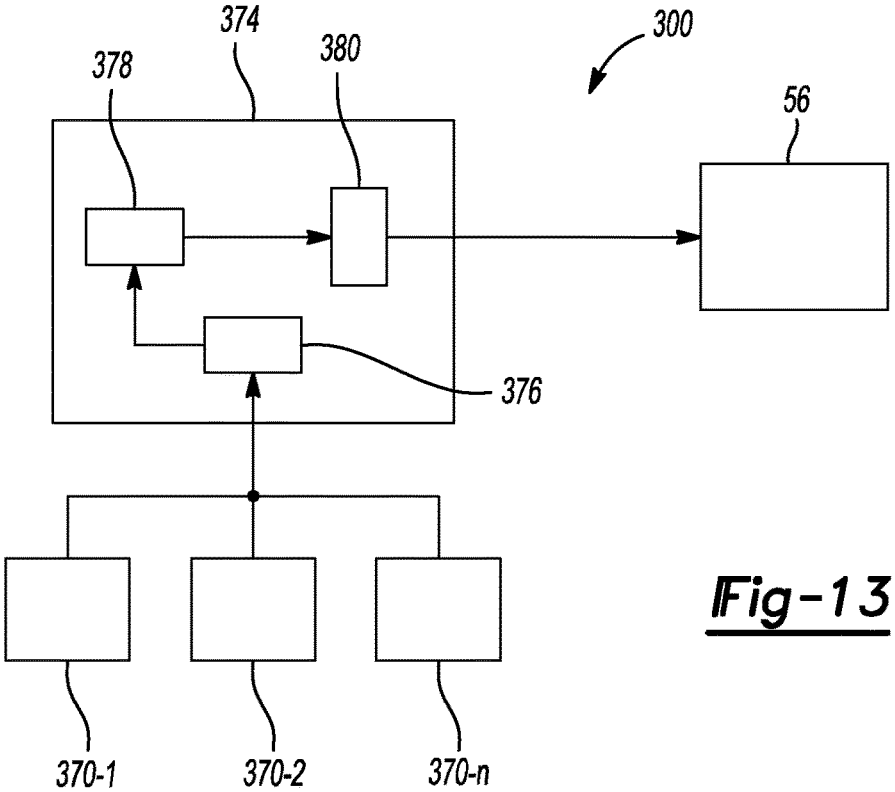
FIG. 13 is a functional block diagram of an example control system in accordance with the principles of the present disclosure.

With reference to FIG. 13, an exemplary control system 300 for use with the merchandising system 150 is illustrated. The control system 300 may include one or more sensors 370-1, 370-2, . . . **370-*n* and a controller 374. As will be explained in more detail below, the sensors 370-1, 370-2, . . . 370-*n* may communicate with the controller 374 to control the operation of a driver (e.g., motor 56, motor 156), and thereby control a user's access to a product (e.g., package 86, package 186) in a product dispenser (e.g., product dispenser 2, product dispenser 102). For example, the sensors 370-1, 370-2, . . . 370-*n* may communicate with the controller 374 to control the operation of a driver (e.g., motor 56, motor 156), and thereby control a user's access to a product (e.g., package 86, package 186) in a channel (e.g., channel 13) defined by the product dispenser (e.g., product dispenser 2, product dispenser 102**).

The sensors 370-1, 370-2, . . . **370-*n* may include various types of sensors, such as motion sensors or optical sensors (e.g., camera), for example. In this regard, the sensors 370-1, 370-2, . . . 370-*n* may include any known type of sensor operable to sense, or otherwise identify, a removal of a product from the product dispenser (e.g., product dispenser 2, product dispenser 102). While the control system 300 is generally illustrated to include three sensors 370-1, 370-2, . . . 370-*n*, it will be appreciated that the control system 300 may include more or less than three sensors 370-1, 370-2, . . . 370-*n*** within the scope of the present disclosure.

The controller 374 may be one of various types of controllers (e.g., controller 74), and may include a characteristic module 376, a comparison module 378, and a driver control module 380. The controller 374 may be in communication with the sensors 370-1, 370-2, . . . **370-*n*. For example, the sensors 370-1, 370-2, . . . 370-*n* may send a signal to the controller 374 upon sensing the removal of a product from the product dispenser (e.g., product dispenser 2, product dispenser 102). In particular, the sensors 370-1, 370-2, . . . 370-*n* may send a signal to the characteristic module 376 upon sensing the removal of a product from the product dispenser (e.g., product dispenser 2, product dispenser 102**).

The characteristic module 376 may determine a characteristic (e.g., an actual characteristic) corresponding to removal of a product from the product dispenser. For example, in some implementations, the characteristic module may determine an amount of time T1 elapsed after removal of the product from the product dispenser (e.g., product dispenser 2, product dispenser 102).

In some implementations, the characteristic module 376 may determine a quantity of sensors 370-1, 370-2, . . . **370-*n* that sensed the removal of the product from the product dispenser. In some implementations, the characteristic module 376 transmits the time T1, or the quantity of sensors 370-1, 370-2, . . . 370-*n* that sensed the removal of the product from the product dispenser, to the comparison module 378**.

The comparison module 378 may compare the characteristic (e.g., the characteristic corresponding to removal of a product from the product dispenser) to a threshold characteristic. For example, in some implementations, the comparison module 378 may compare the time T1 to a threshold period of time T0. In this regard, the comparison module 378 may compare the threshold period of time T0 to the time T1 elapsed after removal of the product from the product dispenser (e.g., product dispenser 2, product dispenser 102). In some implementations, the comparison module 378 may compare (i) the quantity of sensors 370-1, 370-2, . . . **370-*n*** that sensed the removal of the product from the product dispenser to a threshold quantity of sensors.

The driver control module 380 may control a driver (e.g., motor 56, motor 156). For example, the driver control module 380 may activate the driver when the characteristic is greater than the threshold characteristic T0. In some implementations, the driver control module 380 is in communication with the comparison module 378. In particular, the comparison module 378 may transmit a signal to the driver control module 380 when the time T1 is greater than the threshold period of time T0. In response to the signal transmitted from the comparison module 378 to the driver control module 380, the driver control module 380 may transmit an activation signal to the driver, causing the driver to activate.

In some implementations, the driver control module 380 encrypts one or more of the signals transmitted from the sensors 370-1, 370-2, . . . **370-*n*, the characteristic module 376, or the comparison module 378. The encrypted signal may define an identity of the product disposed on the product dispenser (e.g., product dispenser 2, product dispenser 102), an identity of the product dispenser (e.g., product dispenser 2, product dispenser 102), or a location of the product dispenser (e.g., product dispenser 2, product dispenser 102). The driver control module 380 may send the encrypted signal to a central data analysis unit (e.g., central data analysis unit 78) that is in communication with a plurality of the control systems 300. In this way, as previously described, the merchant may obtain real-time updates on which product is being offered for sale at a particular product dispenser (e.g., product dispenser 2, product dispenser 102), the location of the particular product dispenser (e.g., the location of the product dispenser 2, 102) on a shelf, or the location of the product dispenser (e.g., product dispenser 2, product dispenser 102**) in the store.

Figure 14:
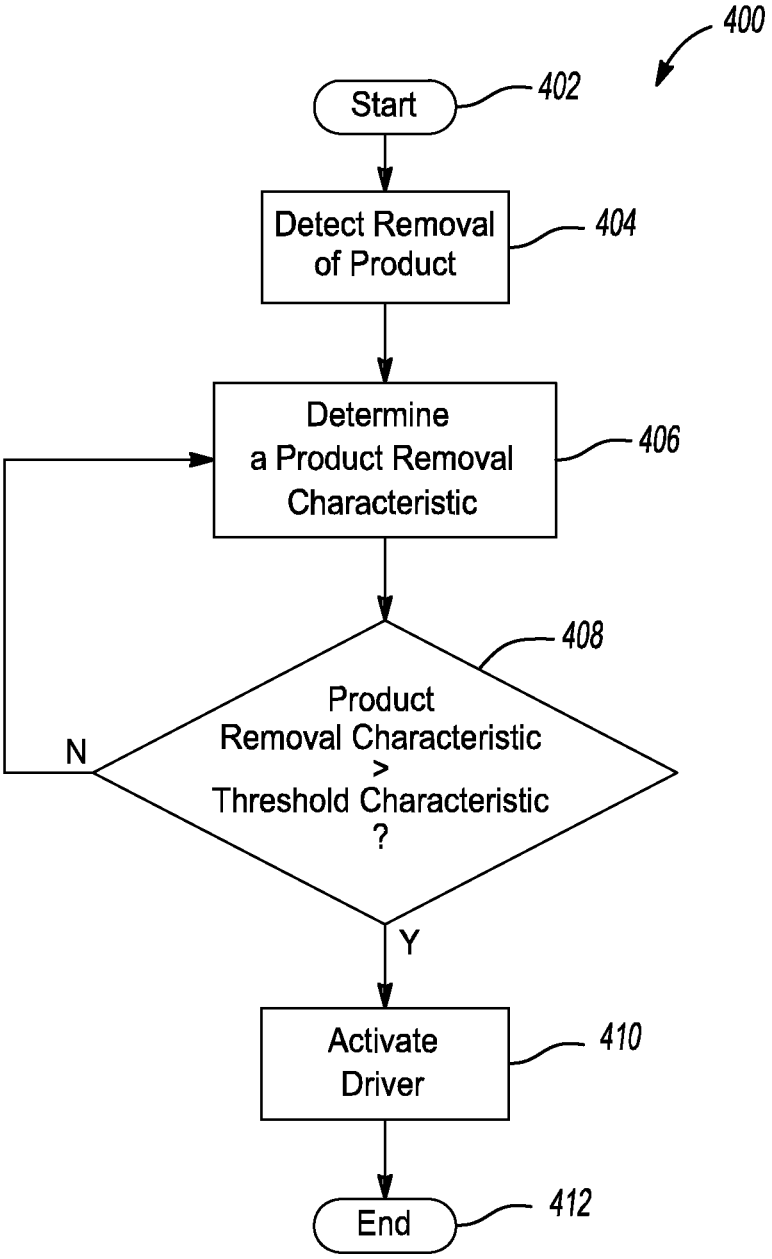
FIG. 14 is a flowchart illustrating an example control method in accordance with the principles of the present disclosure.

With reference to FIG. 14, a method 400 for controlling a product dispenser (e.g., product dispenser 2, product dispenser 102) begins at 402. At step 404, the method may include detecting a removal of a product from the product dispenser (e.g., product dispenser 2, product dispenser 102). For example, one or more of the sensors 370-1, 370-2, . . . **370-*n* may detect the removal of a product from the product dispenser (e.g., product dispenser 2, product dispenser 102). Upon sensing the removal of a product from the product dispenser (e.g., product dispenser 2, product dispenser 102), the sensors 370-1, 370-2, . . . 370-*n* may transmit a signal to the control module 374**.

At step 406, the method 400 may include determining a product removal characteristic with the control module 374. In some implementations, the product removal characteristic may include an amount of time (e.g., T1) elapsed after removal of the product from the product dispenser. In this regard, the product removal characteristic may include the amount of time elapsed since the detection of the removal of the product at step 404. In other implementations, the product removal characteristic may include the quantity of sensors detecting removal of the product from the product dispenser. For example, if there are three sensors 370-1, 370-2, . . . **370-*n***, the product removal characteristic may include the quantity (e.g., 0, 1, 2, or 3) of sensors detecting removal of the product from the product dispenser.

At step 408, the method may include comparing the product removal characteristic to a threshold product removal characteristic with the control module 374. For example, at step 408, the method may include determining whether the product removal characteristic is greater than the threshold product removal characteristic. In this regard, if the product removal characteristic includes an amount of time (e.g., T1) elapsed since the detection of the removal of the product at step 404, as previously described, then, at step 408, the method may include determining whether the amount of time (e.g., T1) is greater than a threshold period of time. The threshold period of time may be greater than five seconds. In some implementations, the threshold period of time is greater than fifteen seconds. In particular, the threshold period of time may be between fifteen seconds and sixty seconds.

If the product removal characteristic includes the quantity of sensors detecting removal of the product from the product dispenser at step 404, then, at step 408, the method may include determining whether the quantity of sensors detecting removal of the product from the product dispenser is greater than a threshold quantity of sensors. In some implementations, the threshold quantity of sensors may be greater than fifty percent of the total quantity of sensors. For example, if there are three sensors 370-1, 370-2, . . . **370-*n*, the controller 374 may survey (e.g., receive signals from) the three sensors 370-1, 370-2, . . . 370-*n* and actuate the motor (e.g., motor 56, motor 156) if at least two of the sensors 370-1, 370-2, . . . 370-*n* indicate that a product (e.g., package 86, package 186**) has been removed from the product dispenser.

If step 408 is false, the method 400 may return to step 406. If step 408 is true, the method 400 may proceed to step 410, where the control module 374 may activate the driver (e.g., motor 56, motor 156). For example, if step 408 is true, the driver control module 380 may transmit an activation signal to the driver, causing a product (e.g., package 86, package 186) to move towards a front edge (e.g., front edge 22), and away from a rear edge (e.g., rear edge 24), of the product dispenser.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to"

another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Various implementations of the systems and techniques described herein can be realized in digital electronic and/or optical circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" and "computer-readable medium" refer to any computer program product, non-transitory computer readable medium, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

The processes and logic flows described in this specification can be performed by one or more programmable processors or controllers executing one or more computer programs to perform functions by operating on input data and generating output. The processes and logic flows can also be performed by special purpose logic circuitry, e.g., an FPGA (field programmable gate array) or an ASIC (application specific integrated circuit). Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

What is claimed is:

1. A product-dispensing system comprising:

a plurality of product dispensers, each product dispenser defining a product dispensing path and including:

a housing extending along a product dispensing path;

a pusher configured to translate along the product dispensing path;

a driver operably coupled to the pusher and configured to urge the pusher along the product dispensing path; and a primary controller in communication with the driver and operable to activate the driver to urge the pusher along the product dispensing path after a threshold period of time; and a central controller in communication with each primary controller of the plurality of product dispensers, the central controller configured to receive a signal from the primary controller of a first product dispenser of the plurality of product dispensers, wherein the primary controller of a second product dispenser of the plurality of product dispensers is configured to control the driver of the second product dispenser based on whether the signal received by the central controller indicates a removal of a product from the first product dispenser, the product-dispensing system further comprising a first sensor, a second sensor, and a third sensor in communication with the primary controller of the first product dispenser and operable to detect the removal of the product from the first product dispenser, wherein the primary controller of the second product dispenser is configured to control the driver of the second product dispenser based on whether a predetermined quantity of the first, second, and third sensors detect the removal of the product from the first product dispenser.

2. The product-dispensing system of claim 1, further comprising a shroud extending along the product dispensing path, the housing and shroud defining a channel extending along the product dispensing path.

3. The product-dispensing system of claim 1, further comprising a rod coupled to the driver and threadably coupled to the pusher.

4. The product-dispensing system of claim 1, wherein the predetermined quantity is two.

5. The product-dispensing system of claim 1, wherein the threshold period of time corresponds to a predetermined period of time elapsed after removal of a product from the product dispensing path.

6. The product-dispensing system of claim 5, wherein the predetermined period of time is greater than ten seconds.

7. The product-dispensing system of claim 6, wherein the predetermined period of time is less than sixty seconds.

8. The product-dispensing system of claim 5, further comprising a sensor in communication with the primary controller and operable to detect the removal of the product from the product dispensing path.

9. The product-dispensing system of claim 1, further comprising a power source operably coupled to the driver.

10. The product-dispensing system of claim 9, wherein the power source includes a battery supported by the first product dispenser.

* * * * *